United States Patent [19]

Lacka

[11] Patent Number: 4,559,880

[45] Date of Patent: Dec. 24, 1985

[54] SAFE

[76] Inventor: Cemal Lacka, 13 Gayle St., Middletown, N.J. 07748

[21] Appl. No.: 430,151

[22] Filed: Sep. 30, 1982

[51] Int. Cl.[4] ..... E05G 1/02

[52] U.S. Cl. ..... 109/51; 109/39; 109/59 R; 292/37; 70/118

[58] Field of Search ..... 109/39, 41, 43, 51, 109/59 R, 59 T, 60, 61, 62, 66, 68, 70; 292/37; 70/82, 83, 113, 118, 119, 120

[56] References Cited

U.S. PATENT DOCUMENTS

| | | | |
|---|---|---|---|
| 2,879,725 | 3/1959 | Zuver | 109/39 |
| 2,946,214 | 7/1960 | Gotay | 70/118 |
| 3,587,486 | 6/1971 | Heinrichs | 109/51 |
| 4,030,426 | 6/1977 | Lyons | 109/51 |
| 4,258,632 | 3/1981 | LaPointe | 109/59 R |

*Primary Examiner*—Robert P. Swiatek
*Assistant Examiner*—David L. Tarnoff
*Attorney, Agent, or Firm*—Blum Kaplan Friedman Silberman & Beran

[57] ABSTRACT

A safe having improved security and being particularly well suited for securing within a drawer is provided. The safe is formed from a one-piece steel sheet providing a seamless top. A safe door is formed in an opening in the safe top with a door hinged by a hinge with a pin recessed below the top surface to prevent attack. The safe door is locked by a three-point bolting lock. The safe may be secured within a drawer by outwardly projecting bolts which prevent removal of the safe without destroying the drawer. An internal alarm may be set to operate upon removal of the safe from the drawer.

9 Claims, 6 Drawing Figures

FIG. 1
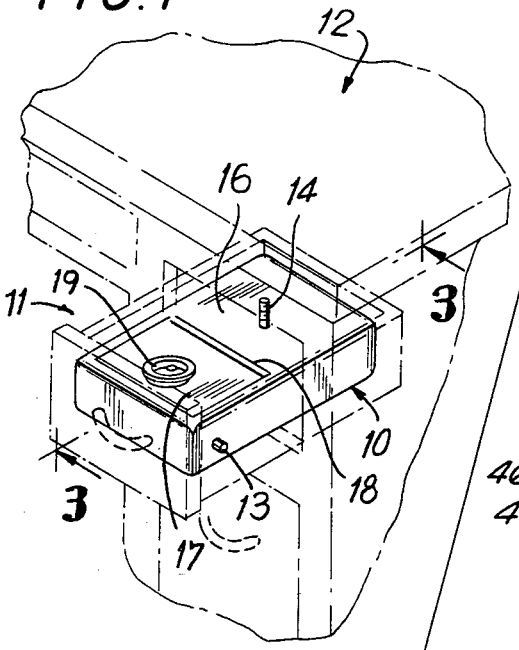
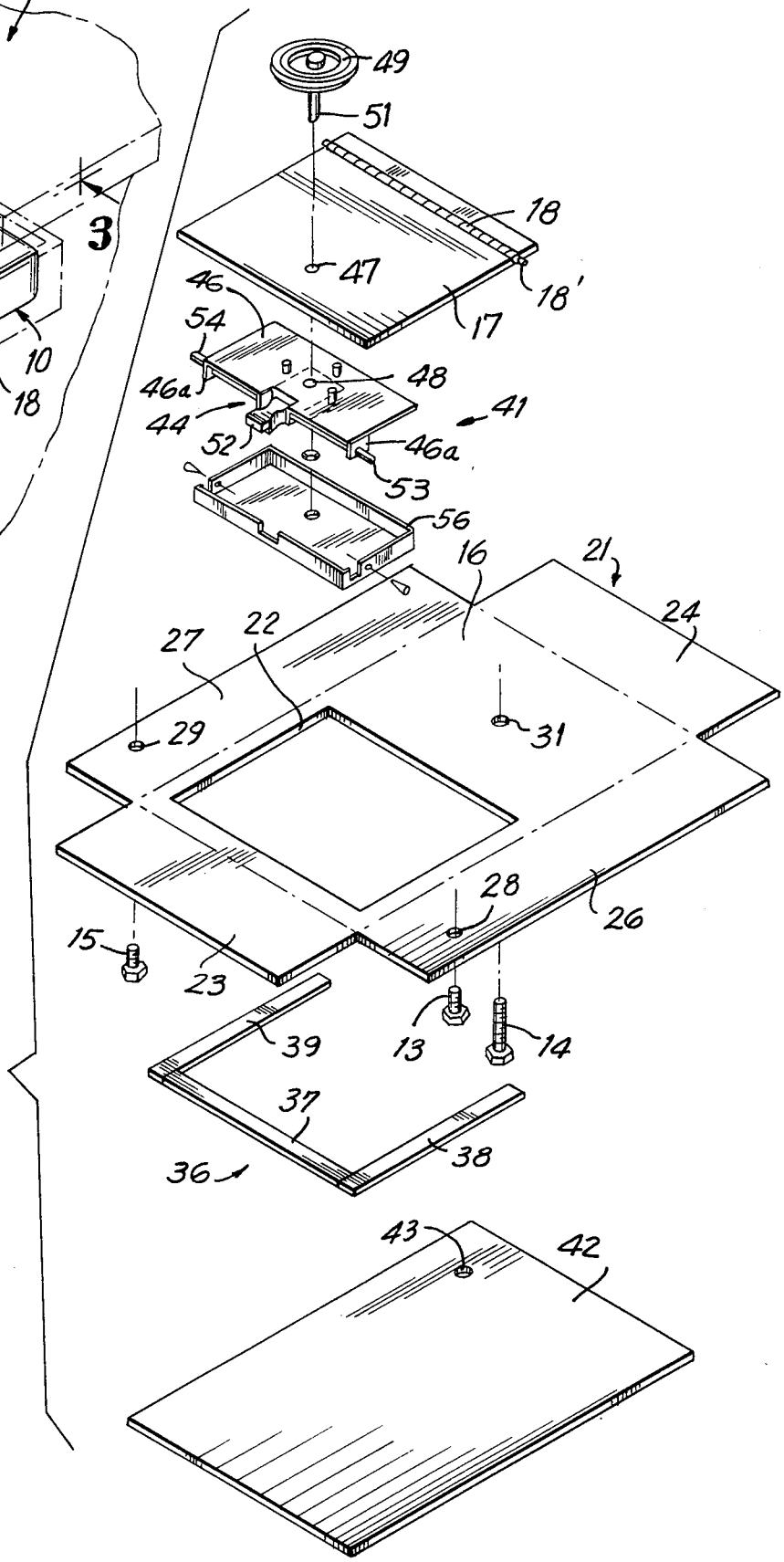
FIG. 2

SAFE

BACKGROUND OF THE INVENTION

Safes are used for a variety of purposes. For example, in a home a person may use a safe for protecting valuables, such as personal jewelry, keepsakes, heirlooms and collectables. In an office, a person may use a safe to protect important documents and other items, such as petty cash and employees' personal possessions. Safes are available in a wide variety of sizes and shapes.

Generally speaking, the more secure and resistant to attack a safe is the larger and heavier the safe is. This makes it impractical to provide convenient secure storage at home or for each individual employee in an office. Smaller and lightweight lock boxes generally available to not provide sufficient attack resistance to store valuable personal effects. For this reason, people often store valuables in a bank safe deposit box. However, in such cases access is subject to the bank hours and a person does not have immediate access to the items stored therein.

In view of this, it would be desirable to provide a compact, relatively light, burglar resistant safe which would prevent the need to store valuables in a bank safe deposit box.

SUMMARY OF THE INVENTION

Generally speaking, in accordance with the invention, an improved burglar resistant safe easily installed and concealed is provided. The safe is formed with a one-piece top steel construction to provide a seamless top. An opening is cut in the safe top to receive a safe door. The door is mounted to the safe top by a hinge having a recessed pin which prevents the hinge from being attacked. A lock is mounted on the door for securing the door in a locked position. When the lock is placed in a locked position a three-bolt lock system securing the door lock on two sides is engaged.

The safe is dimensioned for easy installation and concealment in either a desk, bureau or other piece of furniture. The safe is secured within a drawer by outwardly projecting bolts adjusted from the inside of the saft which prevent removal of the safe from the drawer without destroying the furniture. An internally set alarm may be mounted on the safe bottom over an opening with a projection for contacting the drawer bottom. If the safe is moved when the alarm is set, the projection is permitted to pass through the opening to set off the alarm.

The safe may be conveniently and securing installed without drilling or the need for sophisticated tools. A combination lock may be utilized in the three-bolt locking system which permits the user to enter any desired combination. The three-bolt locking system prevents opening by driving in the lock bolt at the lock position as the bolt has a cam surface which forces the remaining two bolts into the locked position thereby preventing entry.

Accordingly, it is an object of the invention to provide an improved burglar resistant safe.

It is another object of the invention to provide an improved burglar resistant safe including a three-bolt locking system.

It is a further object of the invention to provide an improved burglar resistant safe having a one piece top construction.

Yet another object of the invention is to provide an improved burglar resistant safe including the recessed hinge pin to prevent attack.

Yet further object of the invention is to provide an improved burglar resistant safe which may be readily installed and concealed in a desk or bureau.

Still another object of the invention is to provide a burglar resistant safe including an internal alarm which is set-off if the safe is removed from its secured position.

Still other objects and advantages of the invention will in part be obvious and will in part by apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

FIG. 1 is a perspective view of a safe constructed and arranged in accordance with the invention shown installed in a desk drawer illustrated in phantom;

FIG. 2 is an exploded view of the elements of the safe illustrated in FIG. 1;

DESCRIPTION OF THE PREFERRED EMBODIMENTS

Figure 3:
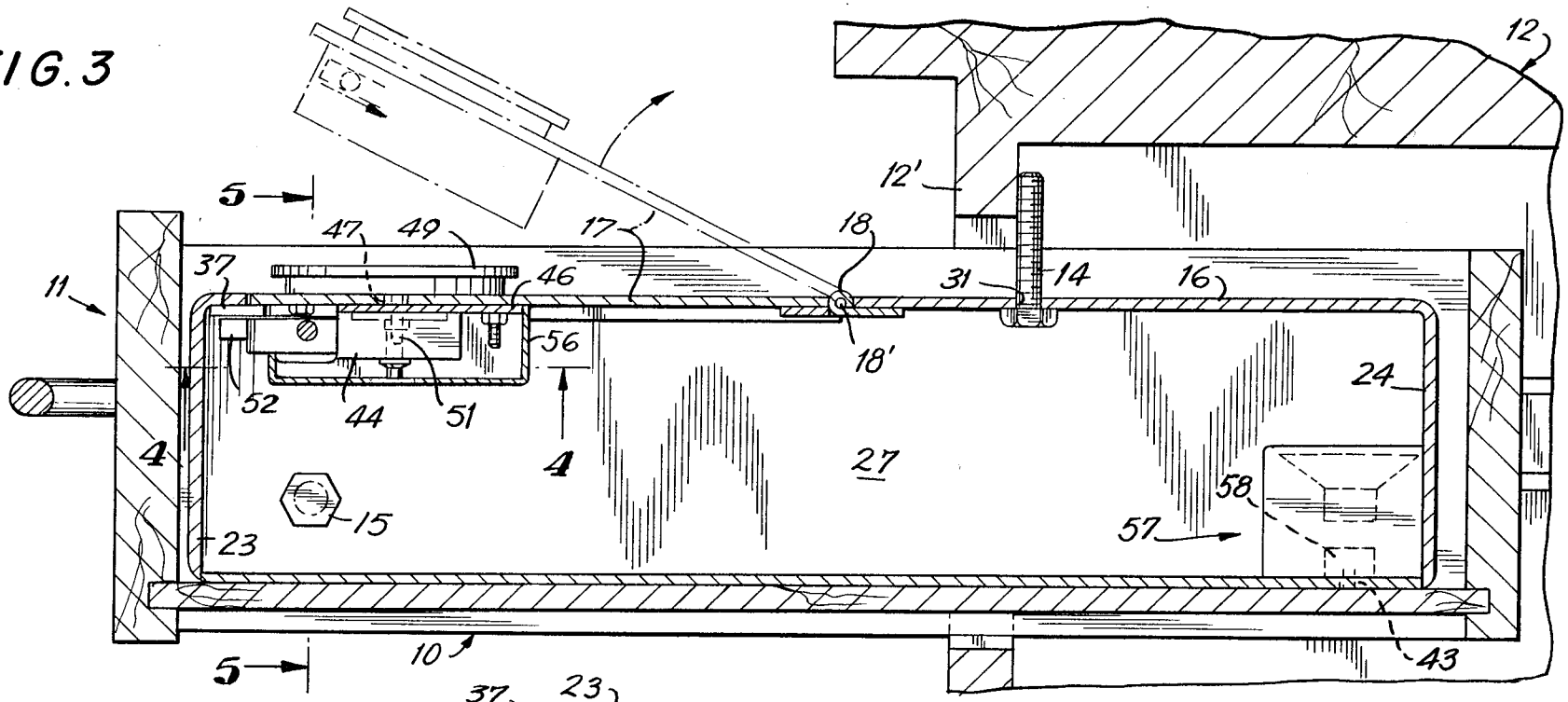
FIG. 3 is a right-side cross-sectional view of the safe illustrated in FIG. 1 through line 3—3.

A safe shown generally as 10 constructed and arranged in accordance with the invention is illustrated in perspective in FIG. 1. Safe 10 is shown secured in a drawer 11 of a desk 12. Safe 10 is secured within drawer 11 by three securing bolts, two of which are shown. A first right side bolt 13 extends outwardly from the right side of safe 10 and a top securing bolt 14 extends upwardly from the back of the top of safe 10 and impinges the frame of desk 12 when drawer 11 is opened. The left side of safe 10 also includes a securing bolt 15. Securing bolts 13, 14 and 15 are adjusted outwardly to contact the sides of drawer 11 and the frame of desk 12 from the inside. Thus, when safe 10 is secured within drawer 11, safe 10 cannot be removed from drawer 11 or drawer 11 cannot be removed from desk 12 without damaging desk 12.

Safe 10 is dimensioned to fit within a desk or bureau and may be formed of any desired size and shape. Safe 10 includes several burglar resistant features which make it particularly well suited for securing personal valuables, such a jewelry, keepsakes, heirlooms and collectables. In safe 10 as illustrated in FIG. 1, the safe has a generally rectangular plan view having a top surface 16 formed with a door 17 for providing access to the interior of safe 10. Door 17 is secured to safe top 16 by a hinge 18. A combination lock 19 is mounted on door 17 for securing door 17 in a closed and locked position.

Referring now to FIGS. 2–6, the individual elements utilized in constructing and assembling safe 10 will now be described. Each of the elements of safe 10 are shown in an exploded condition in FIG. 2. A safe top 16 is formed from a one-piece sheet of steel 21 which permits a top seamless construction of safe 10. This is a first feature which improves the burglar resistance of safe 10. In the embodiment illustrated herein, steel sheet 21 is ⅛th inch steel sheet which is thicker than most home safes for providing a secure and burglar resistant safe. Steel sheet 21 is cut to provide a safe opening 22 and for flaps, a front flap 23 and opposite rear flap 24, a first right side 26 and a second opposed left side 27. Right side flap 26, left side flap 27 and top 16 are provided with holes 28, 29 and 31 which will be used for receiving securing bolts 13, 14 and 15, respectively for securing safe 10 in a drawer as referred to above and as will be described in more detail below.

Flaps 23, 24, 26 and 27 are folded at 90° with respect to top 16 for forming the upper portion of safe 10. The edges of front flap 23 and the edges of rear flap 24 are welded to the adjacent edges of right side 26 and left side 27 for forming the upper portion of safe 10. This construction provides safe 10 with a top 16 without any welded seams exposed along the upper portion. This improves the burglar resistance of safe 10.

A bolt lip 36 having a front side 37, a right side 38 and a left side 39 is welded to the front portion of safe opening 22 for receiving the lock bolts in a three-bolt locking system shown generally as 41 which will be described in more detail below. Locking system 41 is securely mounted to safe door 17. Safe door 17 is secured to the rear side of safe opening 22 by a hinge 18. As indicated above, hinge 18 includes a hinge pin 18' which is recessed below the upper level of safe top 16 so as to make hinge pin 18' inaccessible to attack.

Figure 5:
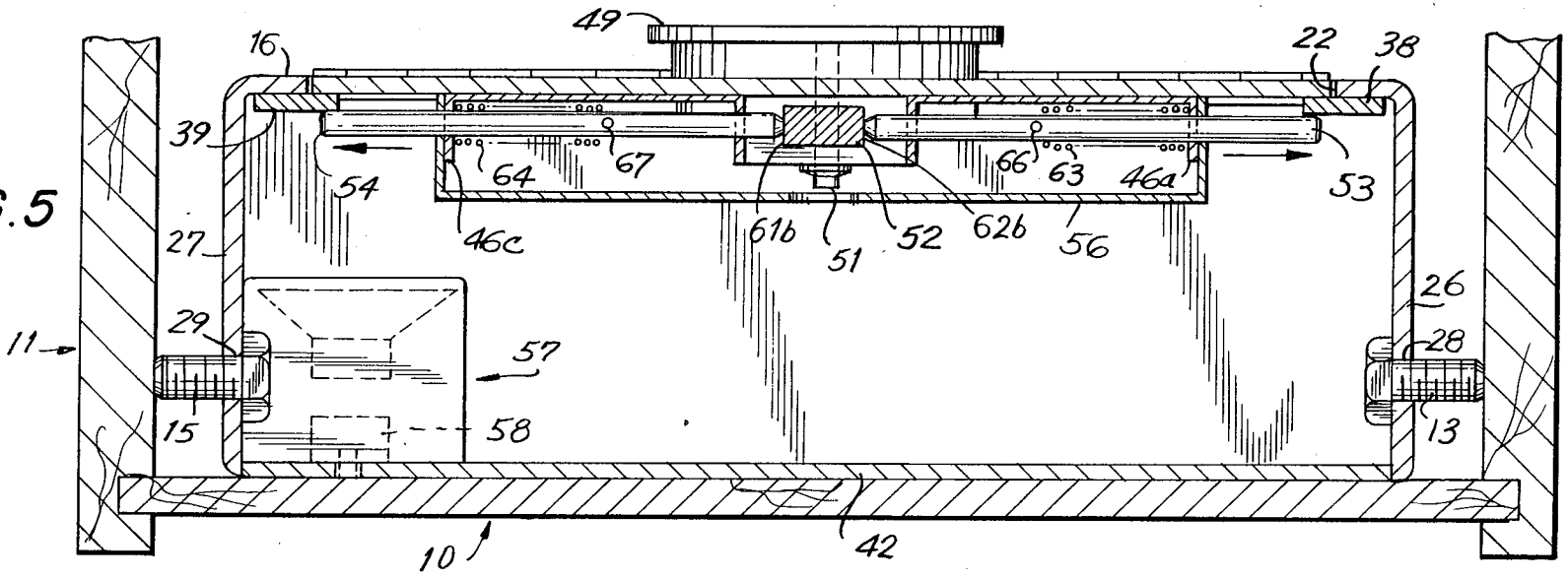
FIG. 5 is a cross-sectional view from the front of the safe illustrated in FIGS. 1, 3 and 4 through line 5—5 of FIG. 3.

After steel sheet 21 is shaped into the upper portion of safe 10, it is welded to a safe bottom plate 42. Safe bottom plate 42 is preferably formed of the same type steel sheet as top 16 and may be formed with an alarm opening 43. An internal alarm shown as 57 in FIGS. 3 and 5 is positioned over alarm opening 43 for receiving an activating button 58 of an internal alarm 57 which may be positioned within safe 10.

In the embodiment illustrated herein three-bolt locking system 41 is operated by a combination lock 44 mounted on a lock plate 46 secured to the lower surface of door 17. A hole 47 is formed in door 17 and aligns with a hole 48 formed in plate 46. A lock dial 49 is mounted on the outer side of door 17 and includes a shaft 51 which extends through holes 47 and 48 for operating combination lock 44. Lock assembly 41 includes a front bolt 52 and a right side bolt 53 and a left side bolt 54. Combination lock 44 and lock bolt assembly 41 are enclosed by a lock cover 56 which encloses bolts 52, 53 and 54 and combination lock 44. Having now described each of the primary elements in safe 10, reference to the cross-sectional views in FIGS. 3–6 will explain how safe 10 and its various burglar resistant features function.

Referring to FIG. 3, safe 10 is shown secured in drawer 11. Top securing bolt 14 is shown engaged with a projecting lip 12' from desk 12 which prevents removal of drawer 11 from desk 12 when safe 10 is secured therein. Alarm 57 is shown positioned in the back of safe 10. Alarm 57 includes projecting finger 58 compressively retained within alarm 57. Finger 58 impinges against the bottom of drawer 11 so that when safe 10 is removed from drawer 11 finger 58 projects through alarm opening 43 is bottom plate 42 of safe 10. When finger 58 extends from alarm 57 a switch within alarm 57 turns the alarm sound on. As alarm 57 is reachable only within safe 10, alarm 57 cannot be turned off when locked safe 10 is removed from drawer 11.

Figure 4:
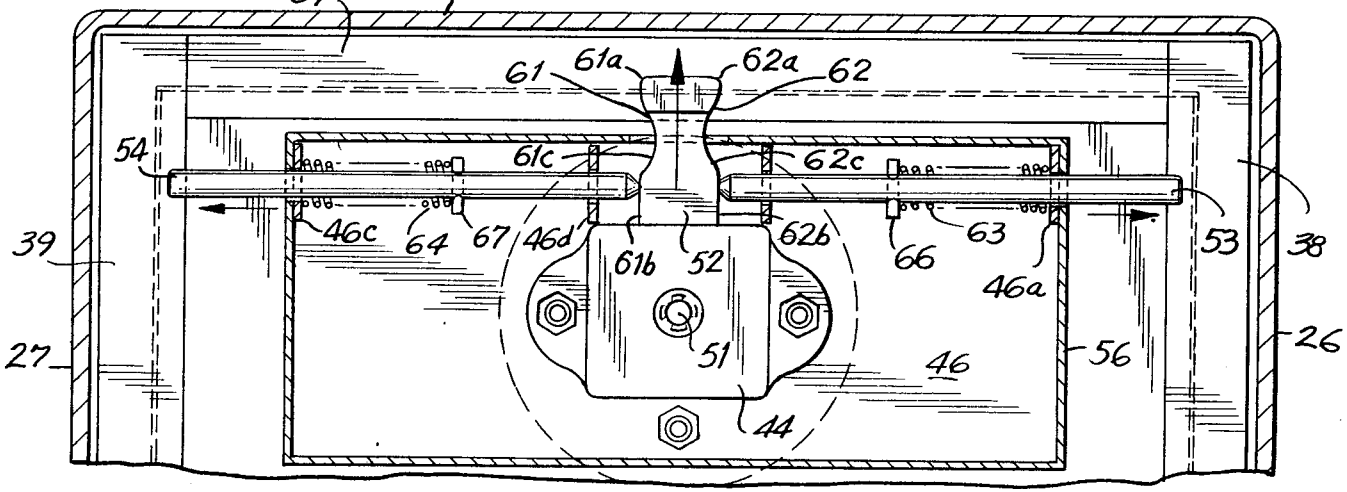
FIG. 4 is a cross-sectional view from the bottom of the safe illustrated in FIGS. 1 and 3 through line 4—4 of FIG. 3 with the three-bolt locking system in a locked position.
Figure 6:
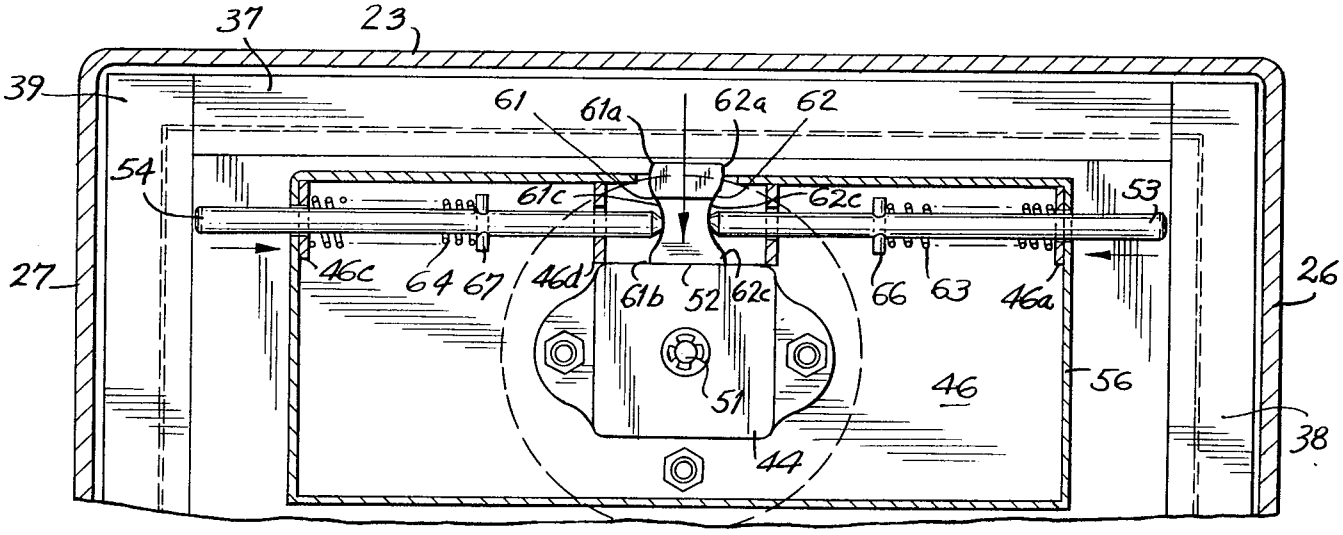
FIG. 6 is a cross-sectional view from the bottom of the safe illustrated in FIGS. 1, 3, 4 and 5 through line 5—5 of FIG. 3 with the three-bolt locking system in an open position.

The cross-sectional sectional view of FIGS. 4 and 6 illustrate three-bolt locking mechanism 41. These cross-sections are taken along the inside of cover 56 so that the three bolts and their locking mechanism are shown. Combination lock 44 may be of any type of cabinet lock, the particular lock illustrated herein is a three wheel, hand-change cabinet lock. The particular model used in the embodiment illustrated herein is available from Sargeant & Greenleaf, Inc. of Nicholasville, Ky. Lock 44 has been modified to include bolt 52 which includes cam surfaces 61 and 62 on the side thereof. The cam surfaces 61 and 62 include two high spots **61*a* and 61*b*, 62*a* and 62*b* and corresponding low spots 61*c* and 62*c***.

Three-bolt locking system 41 also includes right side bolt 53 and left side bolt 54 which are mounted for displacement through tabs **46*a* and 46*b* formed on the right side of lock plate 46 and tabs 46*c* and 46*d* on the left side of lock plate 46, respectively. Lock side bolts 53 and 54 are biased toward bolt 52 by compression springs 63 and 64, respectively. Spring 63 is held in position and biases pins 53 toward lock 44 by a pin 66. Similarly, spring 64 is secured on side bolt 54 by a pin 67**.

When lock 44 is placed in a closed position and bolt 52 is extended in the arrow direction, high spots **62*b* and 61*b* on cam surfaces 61 and 62 force lock side bolts 53 and 54 outwardly in the directions illustrated by the arrows so that bolt 52 and each side bolts 53 and 54 sits below bolt lip 36 of securing door 17** in a closed position.

When lock 44 is placed in an open condition as illustrated in FIg. 6, bolt 52 is retracted into lock 44 and side bolts 53 and 54 are biased towards lock 44 as illustrated by the arrows in FIG. 6. Side bolts 53 and 54 are displaced in the inwardly direction and rest on low spots **61*c* and 62*c* of cam surfaces 61 and 62. When bolt 52 and side bolts 53 and 54 are in this open condition, door 17 can be opened by merely pulling upwardly on dial 49 for providing access to the interior of safe 10**.

By this construction including the camming surfaces on bolt 52, additional burglar protection is provided. For example, if someone attempts to open safe 10 by drillinig a hole in front flap 23 in a central position opposite bolt 52 they will not be able to force open safe 10. For example, if a force is applied pushing bolt 52 to its open position towards lock 44 away from front side 23, side bolts 53 and 54 will be forced outwardly to the condition illustrated in FIG. 4 so that side bolts 53 and 54 will ride under bolt lip 36 thereby locking door 17.

Additional burglar resistance is provided by the features of construction of cabinet lock 44 of three-bolt locking mechanism 41. Shaft 51 connected to dial 49 merely turns the internal mechanism of lock 44. Thus, even if one attempting to open safe 10 removed dial 49, it would not be possible to operate combination lock 44 as the indica would be removed with dial 49. Additionally, it is very difficult to force lock 44 from the top side of door 17 even if dial 49 is removed as lock 44 is secured to door 17 by at least three (3) screws to lock plate 46 which in turn is welded to the bottom of door 17. Additionally, lock cover 56 fits over the entire three-bolt assembly 44 preventing forcing lock 44 down and away from door 17.

Safe 10 illustrating herein is dimensioned for easy installation and concealment in either a home or office desk or a bureau drawer. Safe 10 is formed from a $\frac{1}{8}$th inch steel construction that is generally thicker than most available home safes. The dimensions of safe 10 are approximately $17\frac{1}{2}$ by $11\frac{3}{4}$ by 4 inches for convenient placement in a drawer. By providing securing holes 28, 29 and 31 for receiving securing bolts 12, 14 and 15, easy and secure installation is provided. These bolts make removal of the entire safe from the drawer inconvenient which in and of itself is an additional deterrent to a burglar. Once installed the safe cannot be removed unless the drawer in which it is contained is destroyed. If the internal alarm is set this provides additional deterrent to removing the safe.

Most significantly, the three-bolt locking system including a main lock bolt having two side camming surfaces for locking the side bolt when the main bolt is forced inwardly makes the safe almost impregnable. This is particularly useful given the particularly light weight and portability of the safe.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention, which as a matter of language, might be said to fall therebetween.

What is claimed is:

1. A safe comprising:

a steel box having two opposed and spaced apart parallel planar surfaces for defining a top surface and a bottom surface and four side surfaces substantially at right angles to the top and bottom surfaces, the box having an interior for storing valuables therein, one surface formed with an opening in at least a portion of the surface thereof for providing access to the interior;

a door mounted in the opening for opening and closing the safe and dimensioned to fit snuggly into the opening when the door is in a closed position;

lock means mounted on the door for selectively placing the door in a locked condition; and bolt means operatively coupled to said lock means for engaging the surface formed with the opening for locking the safe, said bolt means including a main bolt adapted for displacement towards one side of the opening and two side bolts operatively coupled to said main bolt and adapted to be displaced away from said main bolt in response to displacement of said main bolt, said main bolt formed with two opposed cam side edges having a front and a rear high spot and a central low spot, the side bolts biased towards and riding on the cam edges and adapted to be displaced away from said main bolt by the high spots when said main bolt is displaced away from the lock means and when said main bolt is forced towards said lock means, and said side bolts being biased towards said low spots away from the sides of the opening when said lock means is in an open condition whereby said side bolts engage the surface formed with the opening at two sides of the opening adjacent to the main bolt in response to said lock means being placed in a locked condition.

2. The safe of claim 1, wherein said lock means is a combination lock including a lock body and oe main bolt which is displaced away from the lock body when the lock is placed in a locked condition.

3. The safe of claim 1, wherein said door is mounted to said top by a hinge having a hinge pin with said hinge mounted to said top so that the hinge pin is recessed below the surface of the top for making the hinge pin resistant to attack.

4. The safe of claim 1, wherein said steel box is formed from a first piece of steel sheet cut for forming the top and four sides and a second steel sheet for forming the bottom, the sides being folded and welded at the corners for forming a safe without any seams on the top thereby making the safe more resistant to attack.

5. The safe of claim 1, further including at least one opening in one of said sides and top for receiving a securing bolt for extending away from said top or side, said bolt adjustable from the inside of said safe for securing the safe to the inside of a piece of furniture when the safe is in a locked condition.

6. The safe of claim 5, including three openings, a first opening in the top and one opening in each of two opposed sides for receiving three securing bolts for securing the safe inside the furniture at two opposed sides and the top.

7. The safe of claim 1 or 6, further including a hole in the bottom and an alarm adapted to turn on when said safe is picked up from a supporting surface, said alarm having an alarm body, an actuating finger switch biased outwardly and which turns on when said finger extends away from said alarm body, said alarm positioned over said hole with said finger extending into said hole and retracted into said alarm body by the supporting surface, said alarm turning on when said safe is picked up from a supporting surface and said finger is displaced outwardly to its on position thereby sounding the alarm.

8. A portable safe comprising:

a steel box dimensioned to fit into a desk drawer having two opposed and spaced apart parallel planar surfaces for defining a top surface and a bottom surface, respectively, and four sides including a front surface, a back surface and two side surfaces substantially at right angles to the top and bottom surfaces, the top and four side surfaces formed from a single piece of steel sheet, the box having an interior for storing valuables therein, the top formed with an opening in at least a portion of the surface thereof for providing access to the interior;

a door mounted in the opening end dimension to fit snuggly into the opening when the door is in a closed position;

lock means mounted on the door for selectively placing the door in a locked conditioned;

bolt means including a main bolt operatively coupled to said lock means for engaging the top at the front side of the opening for locking the safe and two side bolts extending away from the lock means in opposite directions towards the sides of the opening adjacent to the front side when the lock means is in a locked condition, the main bolt formed with opposed cam side edges having a front and a rear high spot and a central low spot, the side bolts biased towards the main bolt cam surfaces and adapted to be displaced away from said main bolt for placing the door in a locked condition by the high spots when said main bolt is displaced away from said lock means and when said main bolt is forced towards said lock means; and a securing hole formed in the top surface and the two opposed sides for receiving from the interior securing bolts for securing the safe within a drawer.

9. The portable safe of claim 8, further including a hole in the bottom and an alarm adapted to turn on when said safe is picked up from a supporting surface, said alarm having an alarm body, an actuating finger switch biased outwardly and which turns on when said finger extends away from said alarm body, said alarm positioned over said hole with said finger extending into said hole and retracted into said alarm body by the supporting surface, said alarm turning on when said safe is picked up from a supporting surface and said finger is displaced outwardly to its on position thereby sounding the alarm.

* * * * *